United States Patent [19]

Fukuchi

[11] Patent Number: 4,535,829

[45] Date of Patent: Aug. 20, 1985

[54] BRAKE APPARATUS FOR WINDING A ROLL-SCREEN

[75] Inventor: Shigeki Fukuchi, Tokyo, Japan

[73] Assignee: Metako Kigyo Co., Ltd., Tokyo, Japan

[21] Appl. No.: 561,187

[22] Filed: Dec. 14, 1983

[30] Foreign Application Priority Data

Dec. 24, 1982 [JP] Japan ..... 57-230334

[51] Int. Cl.[3] ..... E06B 9/208

[52] U.S. Cl. ..... 160/291

[58] Field of Search ..... 160/291–294, 160/305

[56] References Cited

U.S. PATENT DOCUMENTS 471,467 3/1892 Crisson ..... 160/292

2,758,526 8/1956 McFidden ..... 160/294

*Primary Examiner*—Peter M. Caun

[57] ABSTRACT

A brake apparatus for winding a roll-screen is disclosed, which comprises a pipe for winding the roll-screen, a cylinder fixed coaxially within the pipe, a plurality of brake bodies in a specified construction, a fixing brake body also in a specified construction, a viscous fluid optionally filled within the cylinder, the coil springs serving as a one way spring clutch.

The brake apparatus may be applied to any size of the roll-screen by varying the number of the brake bodies.

1 Claim, 10 Drawing Figures

BRAKE APPARATUS FOR WINDING A ROLL-SCREEN

FIELD OF THE INVENTION

This invention relates to a brake apparatus for winding a rollscreen, which is arranged within a winding pipe and may wind the screen quietly and smoothly at a constant speed by suitably controlling a winding operation using, for example, springs.

BACKGROUND OF THE INVENTION

Heretofore, most of roll-screens have utilized an elastically restoring force of a coil spring for winding.

As apparatus for utilizing the elastically restoring force of the coil spring, there have been commerically available an apparatus containing centrifugal clutch for transmitting the elastic force when a rotation rate reaches a predetermined level or other type of clutches, or apparatus directly connected to the coil spring. With the latter apparatus, the winding rate depends on a circumferential velocity of a winding pipe, namely a diameter of the pipe and on a weight (or a length) of a portion of the roll-screen which has been drawn out of the pipe. Thus, upon start of winding a smallest circumference of the pipe and a heaviest weight of the screen make the winding rate slower. As the screen is continuously wound onto the pipe, the circuference of the pipe becomes larger while the weight of the screen is decreased, resulting in the increased winding rate. Thus, toward the end of the winding, the rate of winding the remaining screen is accelerated and becomes very fast. As a result, on the finish of the winding, the rollscreen itself and fittings for the roll-screen may be damaged or adversely affected by an impact of collision.

There have been commercially available various types of clutches for overcoming the disadvantage as described above, such as a centrifugal clutch which may utilize an elastic force of a coil spring as a winding force upon a predetermined level of the rotation rate and is very convenient in handling. In other words, the centrifugal clutch includes a mechanism which does not convert the elastic force to the winding force until the predetermined rotation rate by using a coil spring of weak elastic force. In general, the weak elastic force of the coil spring can not initiate the winding of the roll-screen at the start requiring a considerable energy. The centrifugal clutch does not transmit the winding force until the predetermined rotation rate and actuates a clutch upon reaching the predetermined rotation for converting the elastic force (or rotational force) into the winding force, but may overcome the stationary energy at the start of winding the roll-screen. Thus the centrifugal clutch has no problems in winding the roll-screen at the start, but has a disadvantage in that when the winding is discontinued in the half way and subsequently restarted the elastic force is weakened correspondingly so that the winding can no longer be done. If the coil spring of a stronger elastic force is used for overcoming such disadvantage, the winding force at the start is correspondingly strong, so that the damage of the roll-screen may frequently occur at the start of the winding.

SUMMARY OF THE INVENTION

In view of the foregoing, in accordance with the invention there is provided a brake apparatus for winding a roll-screen which may solve the problems as described above, may be applicable to any size of the roll-screen and may be designed in a compact form, and which comprises a pipe for winding the roll-screen; a cylinder fixed coaxially within the pipe; a plurality of brake bodies in the form of a double-cylinder integrated at its intermediate part, an inner cylinder of which is tapered toward its end faces or its center, said brake bodies being arranged in series within the cylinder and being slidably rotatable on the inner circumference of the cylinder; a fixing brake body in the form of a double-cylinder having a diameter equal to the brake body and closed one end, or in the form of a single-cylinder of a shape lacking an outer cylinder of the double-cylinder, said fixing brake body being arranged in one end of the cylinder and having its open end abutted to the brake body, said fixing brake body being provided at its bottom center opposite to the open end with a fixing shaft having a top end extended from one end of the winding pipe; a viscous fluid optionally filled between the outer circumference of the brake body and the fixing brake body on one hand and the inner circumference of the cylinder on the other hand; and coil springs having an inner diameter slightly less than an outer diameter of the inner cylinder and wound in the winding direction of the roll-screen, said coil springs being fixed over the inner cylinder of the fixing brake body and the adjacent brake body and over the inner cylinders of the adjacent brake bodies to form an one way spring clutch having a play or a torsional flexure in one way of the winding direction.

The invention will be described in more detail for better understanding with reference to the accompanying drawings for the preferred embodiments.

PREFERRED EMBODIMENTS OF THE INVENTION

Figure 1:
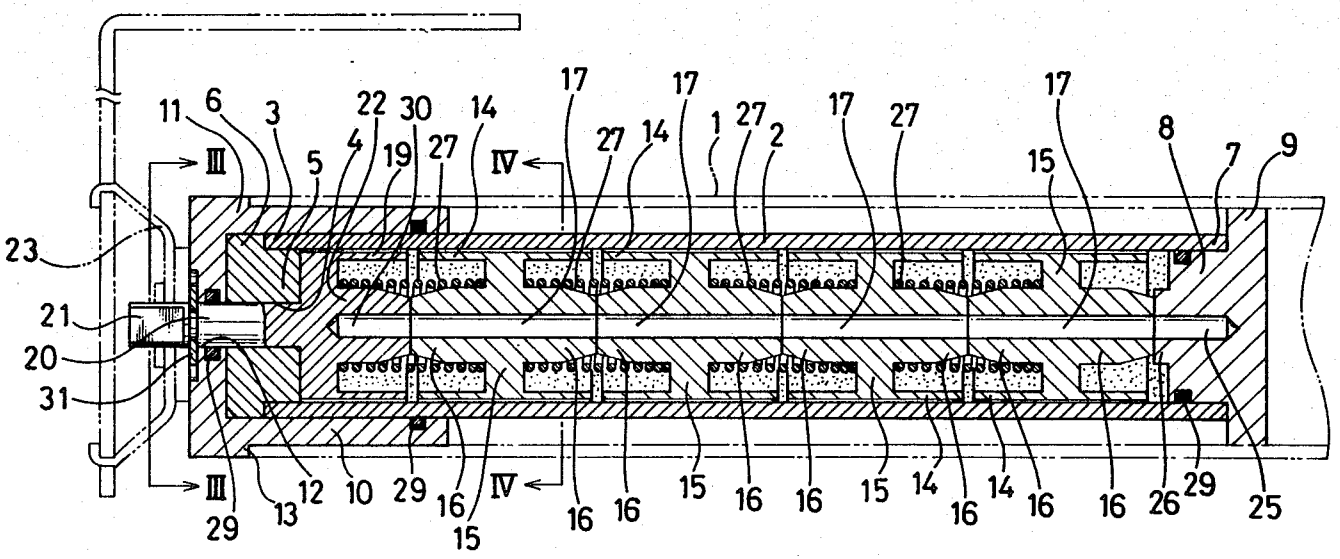
FIG. 1 is a sectional front view of one embodiment of the apparatus according to the invention.
Figure 5:
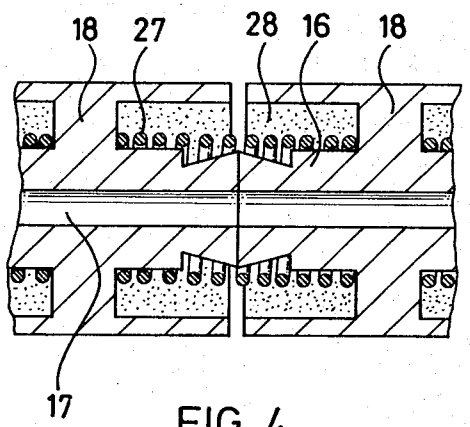
FIG. 5 is a sectional view of a main portion of a further embodiment.
Figure 4:
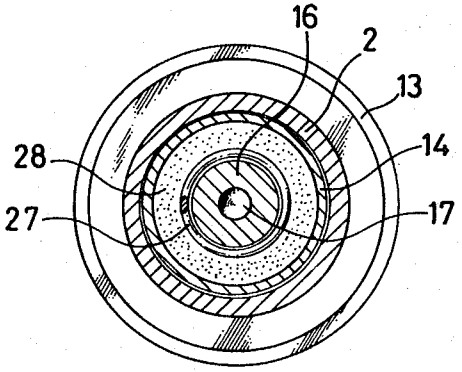
FIG. 4 is a sectional view taken along the line IV—IV in FIG. 1.

Referring to the drawings, a winding pipe 1 for a roll-screen R is provided near its one open end with a coaxial cylinder 2, into which at its one end 3 facing said open end of the pipe 1 is fitted an annular top cover 5 having a hole 4. A fixing shaft 20 of a brake body 22, as described hereinafter, is rotatably into the hole 4. At one end of the top cover 5 is formed a flange 6 of a width equal to a wall thickness of the cylinder 2, which flange serves as a stopper upon insertion of the top cover thereinto. Thus, an outer surface of the cylinder 2 is aligned with that of the flange 6. Into the other end 7 of the cylinder 2 is fitted an annular end cover 8, at one end of which is provided a flange 9 having a diameter equal to an inner diameter of the winding pipe 1.

Onto one end of the top cover 5 and the cylinder 2 is fitted a cylindrical shaft support 10 having a diameter equal to the inner diameter of the winding pipe 1 and abutting against the pipe 1. Through a bottom 11 of the shaft support 10 at its center passes a hole 12 for rotatably supporting a fixing shaft 20 of a brake body 22 as described hereinafter. On an outer circumference of the bottom 11 is provided a flange 13 of a diameter equal to the wall thickness of the pipe 1, which serves as a stopper for the pipe 1, so that an outer surface of the flange 13 may be aligned with that of the pipe 1. Each engagement of the cylinder 2 with the top cover 5, of the cylinder 2 with end cover 8, of the shaft support 10 with flange 6, and of the shaft support 10 with the winding pipe 1 is so strong that vibration and impact of the winding operation can not allow these elements to be disengaged from each other or to slide against each other. Thus, the cylinder 2 is fixed within the widing pipe 1 coaxially and integrally thereto by the flange 9 of the end cover 8 and the outer circumference of the shaft support 10.

On the other hand, within the cylinder 2 is arranged a sliding cylinder 14 capable of sliding and rotating circumferentially, at the middle of which is provided a middle wall 15 for closing the same. Further, at the center of the middle wall 15 at its either side are arranged connecting shafts 16 each being directed to each end of the cylinder 14. The connecting shaft 16 has a top end which is tapered conically toward either end or the center of the sliding cylinder 14. The connecting shaft 16 at its center is provided with a plurality of braking bodies 18 in series each having a hole 17 of an appropriate diameter, which hole is communicated with the connecting shaft 16. Thus, the plurality of the braking bodies are in the form of a double-cylinder integrated each other at their middle part, each body having tapered ends toward the end faces or the center and being slidable and rotable in relation to the inner circumference of the cylinder 2.

Figure 2:
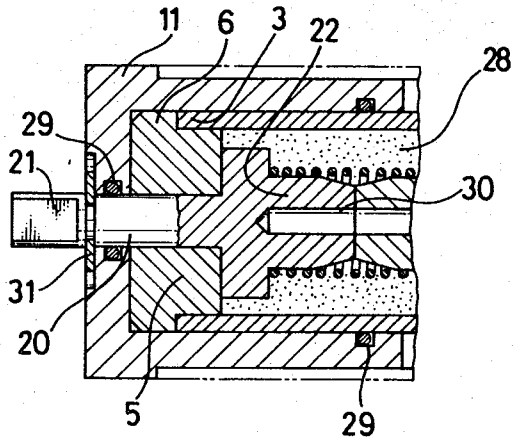
FIG. 2 is a sectional view of a main portion of another embodiment.
Figure 3:
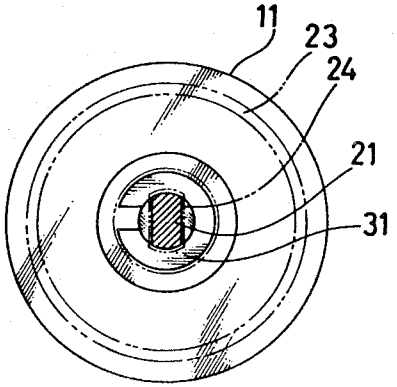
FIG. 3 is a sectional view taken along the line III—III in FIG. 1.

Between the top cover 5 and the brake body 18 is formed a fixing brake body 22 consisting of a double-cylinder of a diameter equal to the brake body 18 and with a bottom 19 having closed its one end, or consisting of a single-cylinder lacking an outer cylinder of the double-cylinder as shown in FIG. 2. The outer cylinder is formed as the sliding cylinder 14 while the inner cylinder as formed as the connecting shaft 16. The cylinder has the open end opposite the brake body 18 and is provided at the center opposite to the open end of the bottom 19 with the fixing shaft 20 which passes rotatably through the hole 4 of the top cover 5 and hole 12 of the shaft support 10. The fixing shaft 20 is protruded from one end of the winding pipe 1 to form a top end 21 of a substantially elongated shape having a cross-section which is defined by two lines symmetrical and parallel to the center of circle, as shown in FIG. 3. A fitting element or a bracket 23 is provided with a hole 24 having the same shape as the top end 21 of the fixing shaft 20, which is unrotably fitted into the hole 24.

In the brake bodies 18 and the fixing brake body 22, the end face of the connecting shaft 16 is formed so as to extend from the open end of the sliding cylinder 14 over a given length. The brake bodies 18 and the fixing brake body 22 are located in such a way that their end faces of the connecting shaft 16 are not connected. The end cover 8 at its center is provided with a hole 25 surrounded by a convex engaging portion 26, as shown in FIG. 1, against which contacted the end face of the connecting shaft 16 not so as to be braked.

Over the connecting shafts 16 of the fixing brake body 22 and the adjacent brake bodies 18 are arranged one way clutch coil springs 27 each having a slightly smaller diameter than the outer diameter of the connecting shaft 16 and being wound in the direction of widing the rollscreen R. Each clutch spring 27 is provided with a play or a torsional flexure in relation to one winding direction. The cylinder 2 is filled with an oil 28 of viscous fluid having low-dependency on temperature, which oil 28 is enclosed between the shaft support 10 and the cylinder 2, between the hole 12 and the fixing shaft 20, as well as between the end cover 8 and the cylinder 2 with oil seals 29. Thus, the oil 28 is also present between the outer circumference of the brake bodies 18, 22 and the inner circumference of the cylinder 2. The cylinder 2 has such a length that an excessive gap may not be formed between the top cover 5, the fixing brake body 22, the plurality of the brake bodies 18, and the end cover 8. Further, the holes 17, 30 and 25 of the brake bodies 18, the connecting shaft 16 and the end cover 8 have the same diameter to form a continuous hollow space.

Figure 6:
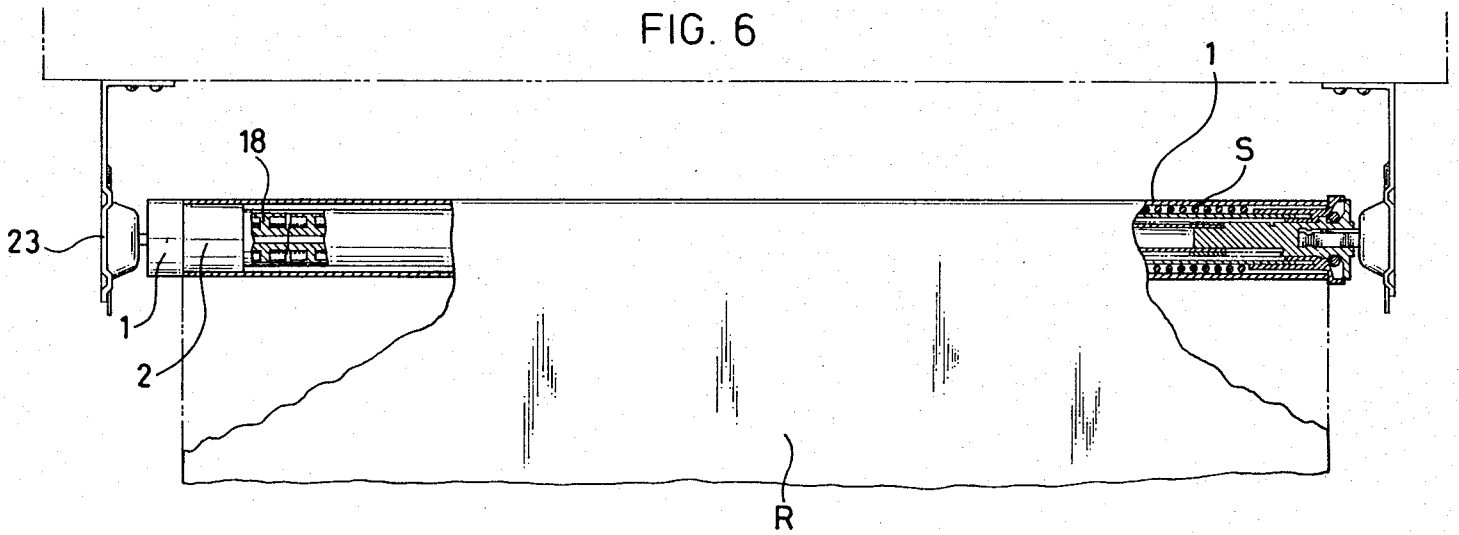
FIG. 6 is a partially broken front view of the apparatus in the mounted state.

Operation of the apparatus according to the invention will be described hereinbelow with reference to FIGS. 1 and 6. By slightly pulling the roll-screen R downwardly to unlock the coil spring S, its elastic restoring force actuates the centrifugal clutch upon reaching the predetermined rotation rate and starts rotation of the winding pipe 1 for winding the roll-screen R. Since the fixing brake body 22 is fixed unrotatably to the bracket 13, the cylinder 2 may rotate together with the winding pipe 1 around the fixing brake body 22 or the fixing shaft 20. Since the oil 28 of viscous fluid is present between the fixing brake body 22 and the inner circumference of the cylinder 2, however, the cylinder 2 may be applied with a constant braking force by viscosity of the oil 28 or may freely rotate. In other words, the winding pipe 1 is somewhat braked or freely rotates without braking.

When the elastic restoring force of the coil spring S overcomes the braking force of the fixing brake body 22 to increase the rotation speed gradually, the diameter of the clutch spring 27 is reduced through its distortion in the winding direction due to friction against the connecting shaft 16 thereby to connect the shaft 16 of the fixing brake body 22 with that of the brake body 18, so that the cylinder 2 is applied with the braking force by the oil 28 present between the fixing brake body 22 and the adjacent brake body 18 to brake the winding speed of the pipe 1.

If the elastic restoring force of the coil spring S overcomes these braking forces, then the next brake body 18 applies the necessary braking force and so on to increase its force sequentially. In this way, a proper braking force is automatically controlled for winding the roll-screen R at the constant speed. As the rotation is carried out in the direction of increasing the diameter of the clutch spring 27 upon pulling out the roll-screen R, the fixing brake body 22 is never connected to the brake body 18, so that the roll-screen may be pulled out by a very weak force.

As described hereinbefore, the number of the working brake bodies 18 depends on the elastic restoring force of the coil spring S. The oil 28 is filled within the cylinder 2 or supplied by the centrifugal force due to rotation of the cylinder 2 even when the oil quantity is reduced between the inner circumference of the cylinder 2 and the brake bodies 18, 22. As the top end of the connecting shaft 16 is tapered conically toward the end faces or the center as shown in FIGS. 1 and 2, the connection may be readily made at the non-tapered portion of the shaft 16 due to the small diameter of the clutch spring 27. However, at the tapered portion of the shaft 16 the clutch spring 27 is distorted due to its much smaller diameter, thereby to prevent the rapid winding of the roll-screen R. Thus, the buffering action may be achieved to protect the roll-screen R from damage.

In accordance with the invention, the pipe 1 for winding the roll-screen R is provided coaxially with the cylinder 2. Within the cylinder 2 are serially arranged the brake bodies 18 each consisting of a doublecylinder intergrated at the middle portion. Each brake body 18 can slidably rotates on the inner circumference of the cylinder 2. Within the cylinder 2 at its one end is arranged the fixing brake body 22 in the form of a double-cylinder having a diameter equal to the brake body 18 and the bottom 19 closed at one end or in the form of a single-cylinder lacking an outer cylinder of the double-cylinder and having its open end directed toward the brake body 18, as shown in FIG. 2. Between the outer circumference of each brake body 18 and fixing brake body 22 and the inner circumference of the cylinder 2 is filled a fluid having a suitable viscosity. Thus, the rotation of the cylinder 2, which rotation is accompanied with the rotation of the winding pipe 1, may be controlled if at least one of the plurality of the brake bodies 18 and the fixing brake body 22 consisted of the doulbe-cylinder is fixed, or if at least one of the plurality of the brake bodies 18 is fixed when the fixing brake body 22 consisted of the cylinder lacking the outer cylinder is employed. Thus, the braking force may be controlled, which is proportional to the number of the working brake bodies.

Further in accordance with the invention, the fixing brake body 22 at its bottom 19 opposite to the open end of the cylinder 2 is provided with the fixing shaft 20 which may fix and extend the top end 21 from one end of the winding pipe 1. Over the inner cylinder 16 of the fixing brake body 22 and the adjacent brake body 18 is arranged one way clutch coil spring 27 having a slightly smaller diameter than the outer diameter of the inner cylinder 16 and being wound in the direction of winding the roll-screen R. The clutch spring 27 is provided with a play or a torsional flexure in relation to one widing direction. Thus, if the top end 21 of the fixing shaft 20 is fixed, as described hereinbefore, to rotate the pipe 1 for winding the roll-screen R, then the spring clutch may allow the brake bodies 18 to be sequentially connected as the winding speed increases. As a result, the speed for winding the roll-screen R may be controlled at a substantially constant level.

Furthermore, the top ends of the inner cylinder of the fixing brake body 22 and the brake body 18 are tapered toward the end faces or the center. Thus, the impact of connection through the spring clutch may be alleviated to prevent the roll-screen R from damage.

Figure 7:
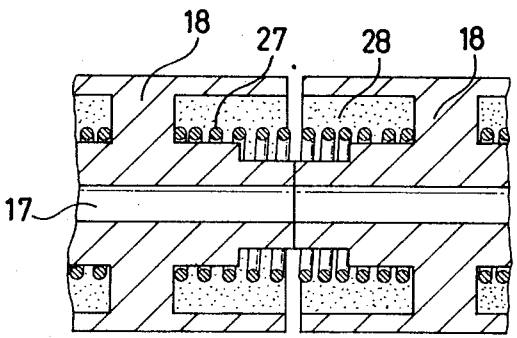

The connecting shaft 16 may be formed stepwise, as shown in FIG. 7, to have a narrow shape. The length of the narow portion may be varied depending on a degree of buffering action, provided that the broad portion is present more or less as a portion for applying a frictional force to the clutch spring.

Figure 8:
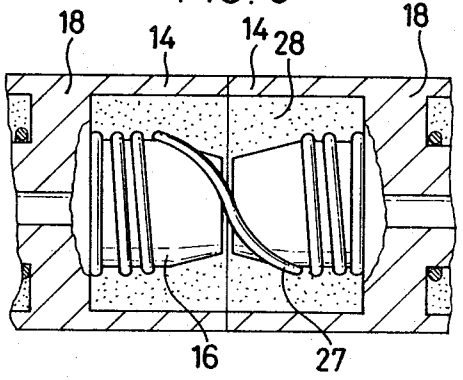
FIGS. 7 to 8 are sectional views of still further embodiments in their main portions.

As shown in FIG. 8, when the connecting shaft 16 does not have an enough length to extend over a gap between the adjacent sliding cylinders 14, 14, the clutch spring 27 may accidentally slip into the gap. In this case, the clutch spring 27 at its middle portion may be somewhat elongated, as shown in FIG. 8, for preventing its skippage into the gap. Thus, the clutch spring 27 may be optionally adjusted as the case may be.

Figure 9:
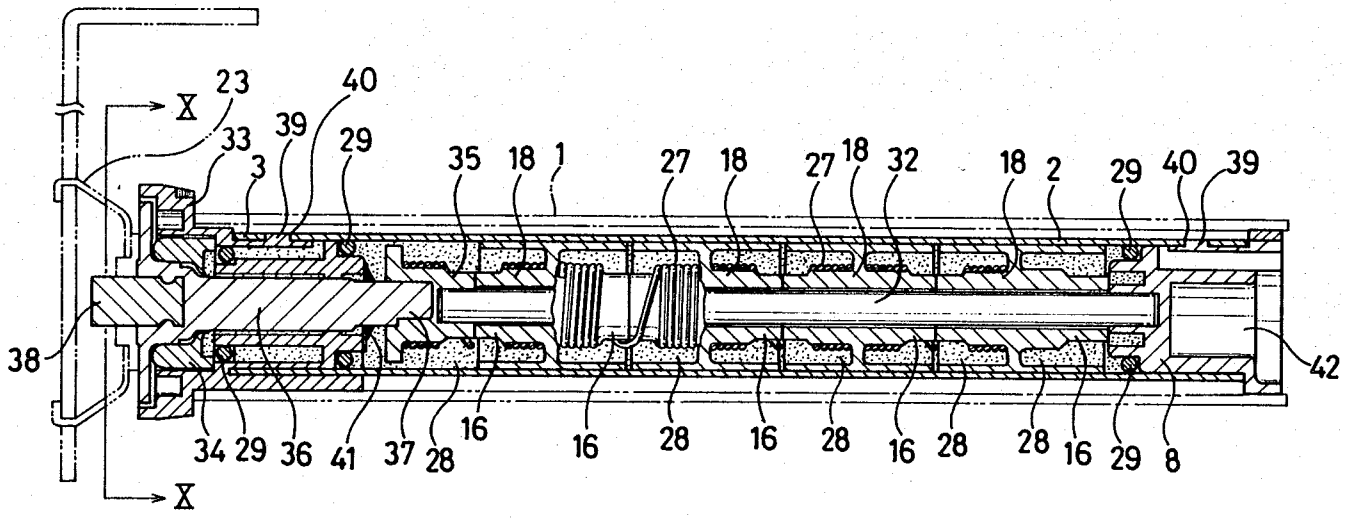
FIG. 9 is a sectional front view of a further embodiment.

As shown in FIG. 9, if the holes 17, 30 and 25 of the brake body 18, the fixing brake body 22 and the end cover 8 have an equal diameter to form a continuous hollow space through which is inserted the rotary shaft 32, then the brake body 18 may rotate smoothly on the rotary shaft 32 for braking.

Figure 10:
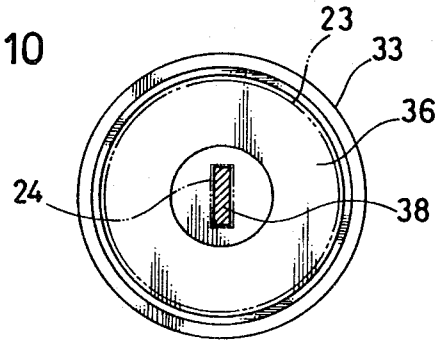
FIG. 10 is a sectional view taken along the line X—X in FIG. 9.

FIGS. 9 and 10 show an embodiment in which the four brake bodies 18 each having the stepwise connecting shaft 16 as shown in FIG. 7 are arranged in series, through the holes 17 of which passes the rotary shaft 32.

Similarly to the previous embodiment, the brake bodies 18 may be arranged within the cylinder 2, which at its one end 3 is provided with a cover 33, which serves as both the top cover 5 and the shaft support 10, through the coil seal 29 for preventing leakage of the coil 28. The cover 33 at its center is provided with the hole 4, through which passes a fixing shaft 36, as described hereinafter. Further, as shown in FIG. 9, at one end 3 of the cylinder 2 is provided an oil seal 34 for preventing the oil 28 from leaking between the fixing shaft 20 and the hole 4 of the cover 33.

Between the brake body 18 nearest to one end 3 of the cylinder 2 and the cover 33 is arranged a fixing brake body 35 which is similar to the fixing brake body 22 as shown in FIG. 2 and in the form of lacking the outer cylinder of the double-cylinder. Through the cover 33 passes the fixing shaft 36, to the extended end 37 of which is fixed the fixing brake body 35. The fixing shaft 36 at its other end is provided with a mounting shaft 38 rectangular in section, which is extended from the cover 33 and through the bracket 38.

The cylinder 2 at its other end 7 is provided with the end cover 8 through the oil seal 29. The cover 33 and the end cover 8 at their circumferences are provided with engaging projections 39 which are normally protruded outward by means of an elastic force. Each projection 39 is engaged with a hole 40 in the cylinder 2, thereby to ensure fixation betwen the cylinder 2 on one hand and the cover 33 and the end cover 8 on the other hand. In this embodiment, the clutch spring 27 at its middle portion is also elongated to extend over the connections shaft 16 as in FIG. 8. Thus, the clutch spring 27 does not slip into the gap between the connecting shafts 16, 16 while the cover 33 and the end cover 8 do not disengage from the cylinder 2. Further, the oil 28 is perfectly enclosed therein for rotating the brake bodies 18 smoothly on the rotary shaft 32.

In the drawings, a numerical reference 31 represents a washer for preventing the fixing shaft 20 of the fixing brake body 22 from passing through the shaft support 10. A reference 41 represents a spring nut for preventing removal of the fixing shaft 36, while 42 represents a space designed for reducing the weight.

As described hereinabove, in accordance with the invention, the number of the working brake bodies 18 may be automatically controlled depending on the rotation speed of the roll-screen R and the braking force may also be controlled by means of the viscous fluid, so that the winding rate may be controlled constantly. Further, even if the strong coil spring is used for allowng the winding to be discontinued in the half way and o be restarted smoothly, the winding rate may be controlled without shock. Further, the apparatus according o the invention may be applied to any size of the roll-creen by varying the number of the brake bodies 18 nd by selectively adjusting the clutch springs 27. In addition, the apparatus according to the invention has advantages in that the winding may be carried out quietly and smoothly, and that the construction is very simple, resulting in a low cost and little malfunction.

What is claimed is:

1. A brake apparatus for winding a roll-screen which comprises a pipe for winding the roll-screen; a cylinder fixed coaxially within a pipe; a plurality of brake bodies in the form of a double-cylinder integrated at its intermediate part, an inner cylinder of which is tapered toward its end faces or its center, said brake bodies being arranged in series within the cylinder and being slidably rotatable on the inner circumference of the cylinder; a fixing brake body in the form of a double-cylinder having a diameter equal to the brake body and closed one end, or in the form of a single-cylinder of a shape lacking an outer cylinder of the double-cylinder, said fixing brake body being arranged in one end of the cylinder and having its open end abutted to the brake body, said fixing brake body being provided at its bottom center opposite to the open end with a fixing shaft having a top end extended from one end of the winding pipe; a viscous fluid optionally filled between the outer circumference of the brake body and the fixing brake body on one hand and the inner circumference of the cylinder on the other hand; and coil springs having an inner diameter slightly less than an outer diameter of the inner cylinder and wound in the winding direction of the roll-screen, said coil springs being fitted over the inner cylinders of the fixing brake body and the adjacent brake body and over the inner cylinders of the adjacent brake bodies to form an one way spring clutch having a play or a torsional flexure in one way of the winding direction.

* * * * *